US005801633A

United States Patent [19]

Soni

[11] Patent Number: 5,801,633

[45] Date of Patent: Sep. 1, 1998

[54] COMBINATION SMOKE, CARBON MONOXIDE, AND HYDROCARBON DETECTOR

[76] Inventor: Govind Soni, 4559 N. Bernard #2, Chicago, Ill. 60625

[21] Appl. No.: 842,223

[22] Filed: Apr. 24, 1997

[51] Int. Cl.[6] ..... G08B 17/10

[52] U.S. Cl. ..... 340/628; 340/632; 340/629; 340/641; 340/642; 340/521; 340/522

[58] Field of Search ..... 340/628, 632, 340/629, 641, 642, 521, 522

[56] References Cited

U.S. PATENT DOCUMENTS

| | | | |
|---|---|---|---|
| 4,305,069 | 12/1981 | Machen et al. | 340/628 |
| 4,335,379 | 6/1982 | Martin | 340/634 |
| 4,633,230 | 12/1986 | Tam | 340/521 |
| 4,688,021 | 8/1987 | Buck et al. | 340/521 |
| 4,845,474 | 7/1989 | Moore et al. | 340/629 |
| 4,871,999 | 10/1989 | Ishii et al. | 340/587 |
| 5,563,578 | 10/1996 | Isenstein | 340/521 |
| 5,589,824 | 12/1996 | Lynch | 340/628 |

*Primary Examiner*—Jeffery A. Hofsass
*Assistant Examiner*—Toan N. Pham

[57] ABSTRACT

A combination smoke, carbon monoxide and hydrocarbon detector including a smoke detection mechanism adapted to transmit a smoke signal upon the detection of smoke, a carbon monoxide detection mechanism adapted to transmit a carbon monoxide signal upon the detection of carbon monoxide, and a hydrocarbon detection mechanism adapted to transmit a hydrocarbon signal upon the detection of hydrocarbon. Next provided is an audio alarm mechanism situated within the housing and connected to the each detection mechanism. The audio alarm mechanism is adapted to emit a high intensity audio alarm upon the receipt of a signal, whereby the type of audio alarm is unique to the signal received. Further provided is control circuitry having a first mode of operation when only one signal is received from the detection mechanism whereby the control circuitry continuously transmits the one signal to the audio alarm means upon the receipt thereof. The control circuitry further having a second mode of operation when more than one signal is received from the detection mechanism whereby the control circuitry alternately transmits each of the signals to the audio alarm mechanism.

1 Claim, 3 Drawing Sheets

| INPUTS | | | | | OUTPUTS | | | | |
|---|---|---|---|---|---|---|---|---|---|
| S | CO | HC | S | S | S | CO | HC | NS | NS |
| 1 | 1 | 0 | X | X | 0 | 0 | 1 | 0 | 0 |
| 1 | 0 | 1 | X | X | 0 | 1 | 0 | 0 | 0 |
| 0 | 1 | 1 | X | X | 1 | 0 | 0 | 0 | 0 |
| 1 | 0 | 0 | 0 | 0 | 0 | 0 | 1 | 0 | 1 |
| 1 | 0 | 0 | 0 | 1 | 0 | 1 | 0 | 0 | 0 |
| 1 | 0 | 0 | 1 | X | 0 | 1 | 0 | 0 | 0 |
| 0 | 0 | 1 | 0 | 0 | 0 | 1 | 0 | 0 | 1 |
| 0 | 0 | 1 | 0 | 1 | 1 | 0 | 0 | 0 | 0 |
| 0 | 0 | 1 | 1 | X | 1 | 0 | 0 | 0 | 0 |
| 0 | 1 | 0 | 0 | 0 | 0 | 0 | 1 | 0 | 1 |
| 0 | 1 | 0 | 0 | 1 | 1 | 0 | 0 | 0 | 0 |
| 0 | 1 | 0 | 1 | X | 1 | 0 | 0 | 0 | 0 |
| 0 | 0 | 0 | 0 | 0 | 0 | 0 | 1 | 0 | 1 |
| 0 | 0 | 0 | 0 | 1 | 0 | 1 | 0 | 1 | 0 |
| 0 | 0 | 0 | 1 | 0 | 1 | 0 | 0 | 0 | 0 |
| 0 | 0 | 0 | 1 | 1 | 1 | 0 | 0 | 0 | 0 |

0 = LOGIC LOW
1 = LOGIC HIGH
X = DON'T CARE

COMBINATION SMOKE, CARBON MONOXIDE, AND HYDROCARBON DETECTOR

BACKGROUND OF THE INVENTION

1. Field of the Invention

The present invention relates to a combination smoke, carbon monoxide and hydrocarbon detector and more particularly pertains to affording a unique method of alerting a user of the presence of more than one harmful substance in the air of a local area.

2. Description of the Prior Art

The use of smoke alarms is known in the prior art. More specifically, smoke alarms heretofore devised and utilized for the purpose of detecting smoke and alerting a user of its presence are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,088,986 to Boucher; U.S. Pat. No. 5,121,101 to Jakubowski et al.; U.S. Pat. No. Des. 360,156 to Fenne; U.S. Pat. No. 5,261,596 to Tachibana et al.; U.S. Pat. No. 5,331,310 to Stetter et al.; and U.S. Pat. No. 5,103,096 to Wong.

In this respect, the combination smoke, carbon monoxide and hydrocarbon detector according to the present invention substantially departs from the conventional concepts and designs of the prior art, and in so doing provides an apparatus primarily developed for the purpose of affording a unique method of alerting a user of the presence of more than one harmful substance in the air of a local area.

Therefore, it can be appreciated that there exists a continuing need for a new and improved combination smoke, carbon monoxide and hydrocarbon detector which can be used for affording a unique method of alerting a user of the presence of more than one harmful substance in the air of a local area. In this regard, the present invention substantially fulfills this need.

SUMMARY OF THE INVENTION

In view of the foregoing disadvantages inherent in the known types of smoke alarms now present in the prior art, the present invention provides an improved combination smoke, carbon monoxide and hydrocarbon detector. As such, the general purpose of the present invention, which will be described subsequently in greater detail, is to provide a new and improved combination smoke, carbon monoxide and hydrocarbon detector which has all the advantages of the prior art and none of the disadvantages.

To attain this, the present invention essentially comprises a housing with a generally rectangular configuration having a front face, a rear face, a top face, a bottom face, and a pair of arcuate side faces defining an interior space. As shown in FIG. 2, the bottom face has a plurality of apertures formed therein for allowing the passage of sound and air. The front face has three circular linearly aligned cut outs formed therein. See FIG. 1. Next provided is smoke detection means situated within the interior space of the housing. In use the smoke detection means is adapted to transmit a smoke signal upon the detection of smoke through the apertures of the housing. Also situated within the housing is carbon monoxide detection means for transmitting a carbon monoxide signal upon the detection of carbon monoxide through the apertures of the housing. Associated therewith is hydrocarbon detection means situated within the interior space of the housing. The hydrocarbon detection means is adapted to transmit a hydrocarbon signal upon the detection of hydrocarbon through the apertures of the housing. As shown in FIGS. 1 & 3, a smoke indication lamp is positioned in one of the cut outs of the housing and is further connected to the smoke detection means. The smoke indication lamp is adapted to illuminate upon the receipt of the smoke signal thereby giving a visual alert of the presence of smoke in a local area. Situated in an adjacent cut out of the housing is a carbon monoxide indication lamp that is connected to the carbon monoxide detection means. In operation, the carbon monoxide indication lamp is adapted to illuminate upon the receipt of the carbon monoxide signal. As such, the present lamp affords a visual alert of the presence of carbon monoxide in the local area. Finally, a hydrocarbon indication lamp is positioned in another one of the cut outs of the housing and is connected to the hydrocarbon detection means. The hydrocarbon indication lamp is adapted to illuminate upon the receipt of the hydrocarbon signal thus giving a visual alert of the presence of hydrocarbon in the local area. With reference now to FIG. 3, audio alarm means is provided. Such audio alarm means is situated within the housing and connected to the each detection means. In use, the audio alarm means is designed to emit a high intensity audio alarm upon the receipt of an activation signal. It is imperative to note that the frequency of the audio alarm is dependent on a frequency of the activation signal. Connected to the audio means is tone control means which is also situated within the housing. The tone control means is adapted for deploying to the audio means a first activation signal having a first unique frequency only upon the receipt of the smoke signal. Further the tone control means is adapted for transmitting a second activation signal having a second unique frequency upon the receipt of the carbon monoxide signal and a third activation signal having a third unique frequency only upon the receipt of the hydrocarbon signal. Further included is state control means situated within the housing and connected between the smoke, carbon monoxide, and hydrocarbon detectors and the tone control means. The state control means is adapted to continuously transmit the smoke signal to the tone control means upon the receipt of the smoke signal with the coincident lack of receipt of the carbon monoxide signal and hydrocarbon signal. The state control means is further adapted to continuously transmit the carbon monoxide signal to the tone control means upon the receipt of the carbon monoxide signal with the coincident lack of receipt of the smoke signal and hydrocarbon signal. In addition, the state control means is adapted to continuously transmit the hydrocarbon signal to the tone control means upon the receipt of the hydrocarbon signal with the coincident lack of receipt of the smoke signal and carbon monoxide signal. To alert a user upon more than one harmful gas has been detected, the state control means is further adapted to alternatively transmit the signals received from the detection means to the tone control upon the coincident receipt of at least two signals from the detection means. As such, a multi-tone audio alarm with a predetermined frequency of oscillation is afforded. Further provided is a plurality of test buttons including a smoke test button situated below the corresponding indication lamp. Such button is adapted to effect the transmission of the smoke signal from the smoke detection means upon the depression thereof. Associated therewith is a carbon monoxide test button situated below the corresponding indication lamp. The carbon monoxide test button is adapted to effect the transmission of the carbon monoxide signal from the carbon monoxide detection means upon the depression thereof. A hydro carbon test button is situated below the corresponding indication lamp and adapted to effect the transmission of the hydrocarbon signal from the hydrocarbon detection means upon the depression thereof. Further provided is battery power monitoring means connected to a battery. The battery monitoring means is adapted to transmit a battery low signal upon power delivered by the battery falling below a predetermined level.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination smoke, carbon monoxide and hydrocarbon detector which has all the advantages of the prior art smoke alarms and none of the disadvantages.

It is another object of the present invention to provide a new and improved combination smoke, carbon monoxide and hydrocarbon detector which may be easily and efficiently manufactured and marketed.

It is a further object of the present invention to provide a new and improved combination smoke, carbon monoxide and hydrocarbon detector which is of a durable and reliable construction.

An even further object of the present invention is to provide a new and improved combination smoke, carbon monoxide and hydrocarbon detector which is susceptible of a low cost of manufacture with regard to both materials and labor, and which accordingly is then susceptible of low prices of sale to the consuming public, thereby making such combination smoke, carbon monoxide and hydrocarbon detector economically available to the buying public.

Still yet another object of the present invention is to provide a new and improved combination smoke, carbon monoxide and hydrocarbon detector which provides in the apparatuses and methods of the prior art some of the advantages thereof, while simultaneously overcoming some of the disadvantages normally associated therewith.

Still another object of the present invention is to afford a unique method of alerting a user of the presence of more than one harmful substance in the air of a local area.

Lastly, it is an object of the present invention to provide a new and improved combination smoke, carbon monoxide and hydrocarbon detector including a smoke detection mechanism adapted to transmit a smoke signal upon the detection of smoke, a carbon monoxide detection mechanism adapted to transmit a carbon monoxide signal upon the detection of carbon monoxide, and a hydrocarbon detection mechanism adapted to transmit a hydrocarbon signal upon the detection of hydrocarbon. Next provided is an audio alarm mechanism situated within the housing and connected to the each detection mechanism. The audio alarm mechanism is adapted to emit a high intensity audio alarm upon the receipt of a signal, whereby the type of audio alarm is unique to the signal received. Further provided is control circuitry having a first mode of operation when only one signal is received from the detection mechanism whereby the control circuitry continuously transmits the one signal to the audio alarm means upon the receipt thereof. The control circuitry further having a second mode of operation when more than one signal is received from the detection mechanism whereby the control circuitry alternately transmits each of the signals to the audio alarm mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
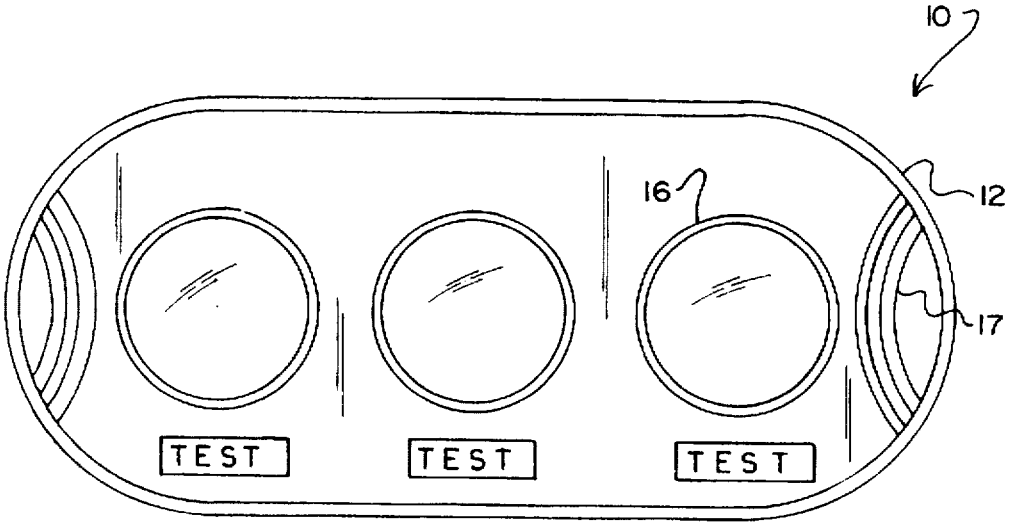
FIG. 1 is an illustration of the preferred embodiment of the combination smoke, carbon monoxide and hydrocarbon detector constructed in accordance with the principles of the present invention.

With reference now to the drawings, and in particular to FIG. 1 thereof, a new and improved combination smoke, carbon monoxide and hydrocarbon detector embodying the principles and concepts of the present invention and generally designated by the reference numeral 10 will be described.

The present invention, the new and improved combination smoke, carbon monoxide and hydrocarbon detector, is comprised of a plurality of components. Such components in their broadest context include a housing, a plurality of detection means, a plurality of lamps, audio alarm means, and control circuitry. Such components are individually configured and correlated with respect to each other so as to attain the desired objective.

Figure 2:
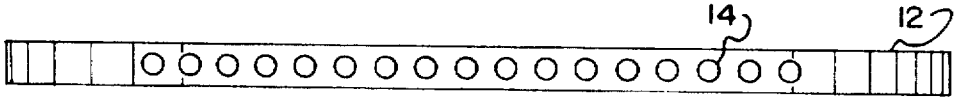
FIG. 2 is a bottom view of the housing of the present invention.

More specifically, it will be noted that the system 10 of the present invention includes a housing 12 with a generally rectangular configuration having a front face, a rear face, a top face, a bottom face, and a pair of arcuate side faces defining an interior space. As shown in FIG. 2, the bottom face has a plurality of apertures 14 formed therein for allowing the passage of air. The front face has three circular linearly aligned cut outs 16 formed therein. See FIG. 1. Also shown in FIG. 1 is a pair of semi-circular sound vents 17 for allowing the uninhibited transmission of sound from the interior space of the housing.

Figure 3:
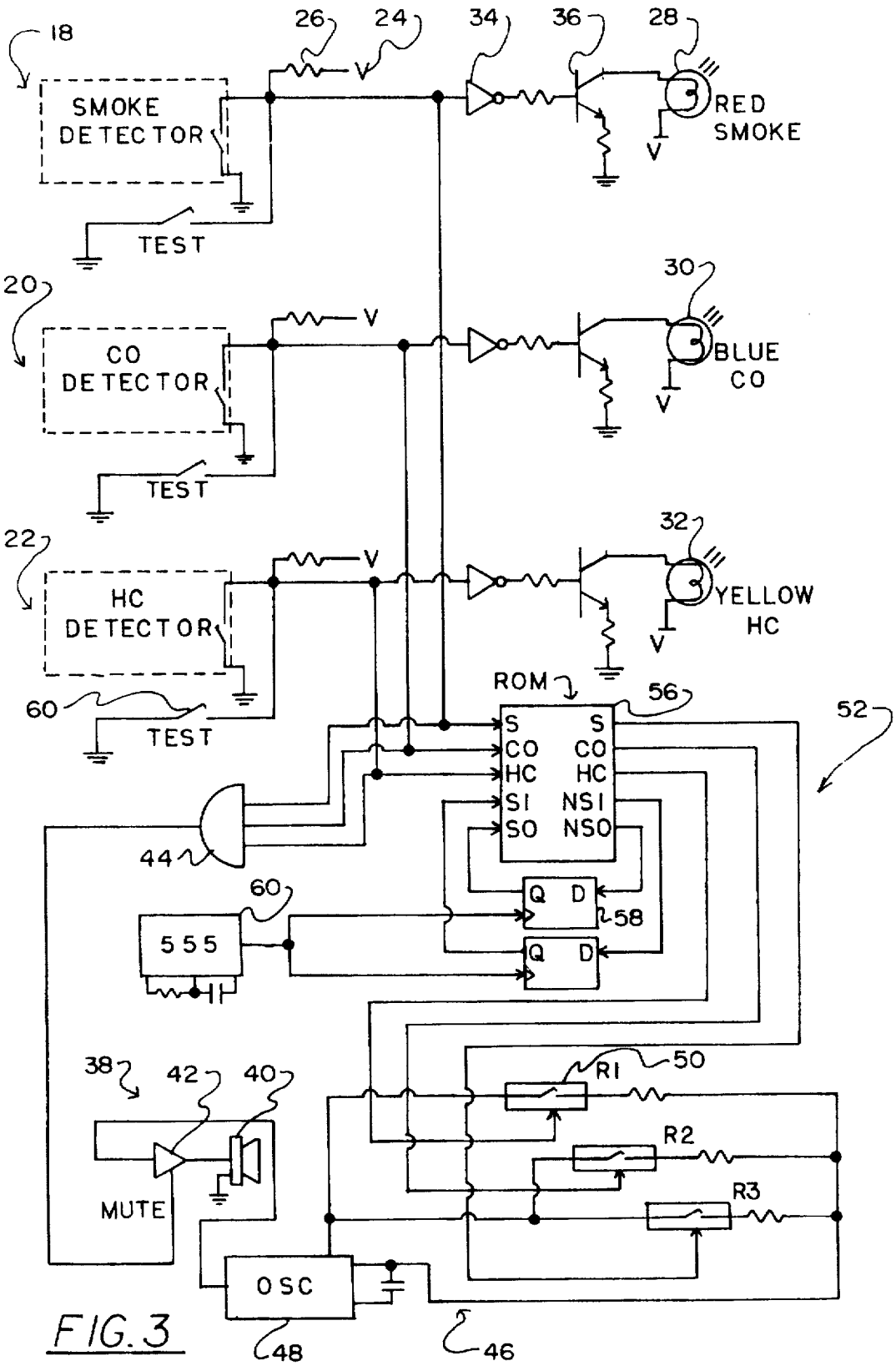
FIG. 3 is a detailed schematic diagram of the control circuitry of the present invention.

Next provided is smoke detection means 18 situated within the interior space of the housing. In use, the smoke detection means is adapted to transmit a smoke signal upon the detection of smoke through the apertures of the housing. Also situated within the housing is carbon monoxide detection means 20 for transmitting a carbon monoxide signal upon the detection of carbon monoxide through the apertures of the housing. Associated therewith is hydrocarbon detection means 22 situated within the interior space of the housing. The hydrocarbon detection means is adapted to transmit a hydrocarbon signal upon the detection of hydrocarbon through the apertures of the housing. Examples of such hydrocarbon is natural and methane gas. As shown in FIG. 3, the detection means each acts as a switch which grounds a voltage source 24 through an associated resistor 26. As such, the signals transmitted from the detectors are active low.

As shown in FIGS. 1 & 3, a red smoke indication lamp 28 is positioned in one of the cut outs of the housing and is further connected to the smoke detection means. The smoke indication lamp is adapted to illuminate upon the receipt of the smoke signal thereby giving a visual alert of the presence of smoke in a local area. Situated in an adjacent cut out of the housing is a blue carbon monoxide indication lamp 30 that is connected to the carbon monoxide detection means. In operation, the carbon monoxide indication lamp is adapted to illuminate upon the receipt of the carbon monoxide signal. As such, the present lamp affords a visual alert of the presence of carbon monoxide in the local area. Finally, a yellow hydrocarbon indication lamp 32 is positioned in another one of the cut outs of the housing and is connected to the hydrocarbon detection means. The hydrocarbon indication lamp is adapted to illuminate upon the receipt of the hydrocarbon signal thus giving a visual alert of the presence of hydrocarbon in the local area. Since the signals transmitted from the detection means are active low, an inverter 34 is necessarily connected between each of the detection means and its associated lamp. Further, transistors 36 are utilized to supply a proper amount of power to the lamps. This is necessary in order to allow the lamp to emit an intense light upon illumination.

With reference now to FIG. 3, audio alarm means 38 is provided. Such audio alarm means is situated within the housing and connected to each detection means. In use, the audio alarm means is designed to emit a high intensity audio alarm upon the receipt of an activation signal. It is imperative to note that the frequency of the audio alarm is dependent on a frequency of the activation signal. In the preferred embodiment, the audio alarm means includes a speaker 40 with an operational amplifier 42 connected to the input thereof. Such amplifier has a mute input. Upon the lack of receipt of each of the signals of the detection means, the mute input remains active thereby precluding the passage of the activation signal thereto. An AND gate 44 is employed to accomplish the foregoing function. The AND gate has three inputs each connected to an associated detector means and an output connected to the mute input.

Connected to the audio means is tone control means 46 which is also situated within the housing. The tone control means is adapted for deploying to the audio means a first activation signal having a first unique frequency only upon the receipt of the smoke signal. Further the tone control means is adapted for transmitting a second activation signal having a second unique frequency upon the receipt of the carbon monoxide signal and a third activation signal having a third unique frequency only upon the receipt of the hydrocarbon signal. As shown in FIG. 3, the tone control means includes an oscillator 48 adapted to transmit the activation signal to the operational amplifier of the audio alarm means with a frequency governed by a capacitor C1 and one of three resistors R1, R2, & R3. Such resistors are coupled to the capacitor in parallel with respect to each other. Associated with each resistor is a voltage controlled switch 50 taking the form of a transistor or the like. The foregoing switches are adapted to connect the associated resistor with the capacitor thus forming a unique RC time constant which affords the unique frequency of the first, second, and third activation signal.

Further included is state control means 52 situated within the housing and connected between the smoke, carbon monoxide, and hydrocarbon detectors and the tone control means. The state control means is adapted to continuously transmit the smoke signal to the tone control means upon the receipt of the smoke signal with the coincident lack of receipt of the carbon monoxide signal and hydrocarbon signal. The state control means is further adapted to continuously transmit the carbon monoxide signal to the tone control means upon the receipt of the carbon monoxide signal with the coincident lack of receipt of the smoke signal and hydrocarbon signal. In addition, the state control means is adapted to continuously transmit the hydrocarbon signal to the audio alarm means upon the receipt of the hydrocarbon signal with the coincident lack of receipt of the smoke signal and carbon monoxide signal. To alert a user when more than one harmful gas has been detected, the state control means is further adapted to alternatively transmit the signals received from the detection means to the tone control means upon the coincident receipt of at least two signals from the detection means. As such, a multi-tone audio alarm with a predetermined frequency of oscillation is afforded. To accomplish the foregoing, the state control means includes a ROM state machine 56, a pair of D-flip flops 58, and a 555 timer 60. Connected to the inputs of the state machine are each of the detection means and the outputs of the D-flip flops. Each of the outputs of the state machine are connected to an associated voltage controlled switches. Additional outputs of the state machine are connected to the inputs of the D-flip flops. In operation, the state machine affords the specific function as set forth hereinabove by operating in a pseudo-single state mode upon receipt of only one signal from the detection means and further operating in a multi-state mode upon the receipt of multiple signals. The state machine accomplishes the forgoing by being programmed to operate in a predetermined sequenced manner as set forth in the state table of FIG. 5. Controlling the transfer of states is the 555 timer which is connected to the reset of the D-flip flops. The 555 timer is configured as a astable multivibrator which provides a pulse every 1–4 seconds. It is this alternating characteristic that ultimately effects the multi-tone characteristic of the audio alarm when two harmful substances are detected in the air.

Further provided is a plurality of test buttons 60 including a smoke test button situated below the corresponding indication lamp. Such button is adapted to effect the transmission of the smoke signal from the smoke detection means upon the depression thereof. Associated therewith is a carbon monoxide test button situated below the corresponding indication lamp. The carbon monoxide test button is adapted to effect the transmission of the carbon monoxide signal from the carbon monoxide detection means upon the depression thereof. A hydro carbon test button is situated below the corresponding indication lamp and adapted to effect the transmission of the hydrocarbon signal from the hydrocarbon detection means upon the depression thereof.

Figures 4, 5:
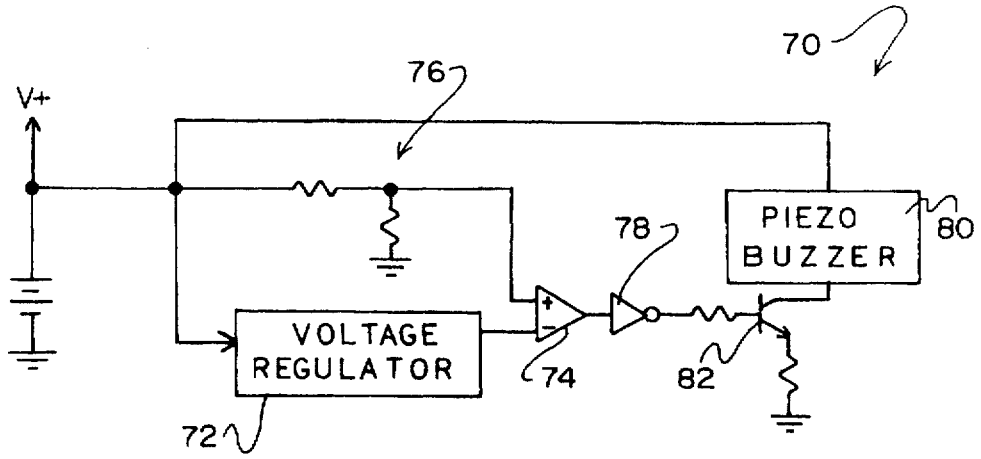
FIG. 4 is a schematic diagram of the battery monitoring means.
FIG. 5 is a logic table associated with the state control means of the present invention.

Further provided is battery power monitoring means 70 connected to a battery. The battery monitoring means is adapted to transmit a battery low signal upon power delivered by the battery falling below a predetermined level. As shown in FIG. 4, the battery power monitoring means includes a voltage regulator 72 coupled between the battery and a negative input of an operational amplifier 74. Further provided is a voltage divider 76 connected between the battery and a positive input of the operational amplifier. By this design, an output of the op-amp goes low upon the battery power falling below a predetermined level as governed by the voltage regulator. An inverter 78 is utilized for transmitting a battery low signal when appropriate. By using the inverter, the battery low signal takes the form of a high pulse. Situated on the housing is a piezo buzzer 80. Such piezo buzzer is connected to the inverter for signaling upon the receipt of the battery low signal. To provide the appropriate amount of power to the buzzer, a transistor 82 is connected between the inverter and the piezo buzzer. A base resistor and emitter resistor may be included to ensure proper operation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination smoke, carbon monoxide and hydrocarbon detector comprising, in combination:

a housing with a generally rectangular configuration having a front face, a rear face, a top face, a bottom face, and a pair of arcuate side faces defining an interior space, the bottom face having a plurality of apertures formed therein, the front face having three circular linearly aligned cut outs formed therein, the housing further including a pair of sound vents for allowing the uninhibited transmission of sound from the interior space of the housing;

smoke detection means situated within the interior space of the housing, the smoke detection means adapted to transmit a smoke signal upon the detection of smoke through the apertures of the housing;

carbon monoxide detection means situated within the interior space of the housing, the carbon monoxide detection means adapted to transmit a carbon monoxide signal upon the detection of carbon monoxide through the apertures of the housing;

hydrocarbon detection means situated within the interior space of the housing, the hydrocarbon detection means adapted to transmit a hydrocarbon signal upon the detection of hydrocarbon through the apertures of the housing;

a smoke indication lamp of a first color positioned in one of the cut outs of the housing and connected to the smoke detection means, the smoke indication lamp adapted to illuminate upon the receipt of the smoke signal thereby giving a visual alert of the presence of smoke in a local area;

a carbon monoxide indication lamp of a second color positioned in one of the cut outs of the housing and connected to the carbon monoxide detection means, the carbon monoxide indication lamp adapted to illuminate upon the receipt of the carbon monoxide signal thereby giving a visual alert of the presence of carbon monoxide in the local area;

a hydrocarbon indication lamp of a third color positioned in one of the cut outs of the housing and connected to the hydrocarbon detection means, the hydrocarbon indication lamp adapted to illuminate upon the receipt of the hydrocarbon signal thereby giving a visual alert of the presence of hydrocarbon in the local area;

audio alarm means situated within the housing and connected to the each detection means, the audio alarm means adapted to emit a high intensity audio alarm upon the receipt of an activation signal, whereby the frequency of the audio alarm is dependent on a frequency of the activation signal;

tone control means situated within the housing and connected to the audio alarm means for deploying a first activation signal having a first unique frequency only upon the receipt of the smoke signal, a second activation signal having a second unique frequency upon the receipt of the carbon monoxide signal, and a third activation signal having a third unique frequency only upon the receipt of the hydrocarbon signal;

state control means situated within the housing and connected between the smoke, carbon monoxide, and hydrocarbon detector and the tone control means, the state control means adapted to continuously transmit the smoke signal to the tone control means upon the receipt of the smoke signal and coincident lack of receipt of the carbon monoxide signal and hydrocarbon signal, the state control means adapted to continuously transmit the carbon monoxide signal to the tone control means upon the receipt of the carbon monoxide signal and coincident lack of receipt of the smoke signal and hydrocarbon signal, the state control means adapted to continuously transmit the hydrocarbon signal to the tone control means upon the receipt of the hydrocarbon signal and coincident lack of receipt of the smoke signal and carbon monoxide signal, the state control means further adapted to alternatively transmit the signals received from the detection means to the tone control means upon the coincident receipt of at least two signals from the detection means thereby effecting an alternating multi-tone audio alarm with each tone having a predetermined frequency of oscillation;

a plurality of test buttons including a smoke test button situated below the corresponding indication lamp and adapted to effect the transmission of the smoke signal from the smoke detection means upon the depression thereof, a carbon monoxide test button situated below the corresponding indication lamp and adapted to effect the transmission of the carbon monoxide signal from the carbon monoxide detection means upon the depression thereof, and a hydro carbon test button situated below the corresponding indication lamp and adapted to effect the transmission of the hydrocarbon signal from the hydrocarbon detection means upon the depression thereof; and battery power monitoring means connected to a battery, the battery monitoring means adapted to transmit a battery low signal upon power delivered by the battery falling below a predetermined level.

* * * * *